United States Patent [19]

Marsh et al.

[11] 4,216,732

[45] Aug. 12, 1980

[54] OPTICAL SWITCHING DESIGN FOR ONE STEP BUTTONHOLING

[75] Inventors: Walter H. Marsh, Fanwood; Howard L. Beckerman, Red Bank; Allan M. Dob, Clifton, all of N.J.

[73] Assignee: The Singer Company, Stamford, Conn.

[21] Appl. No.: 59,865

[22] Filed: Jul. 23, 1979

[51] Int. Cl.[2] ..... D05B 3/06

[52] U.S. Cl. ..... 112/158 B; 112/158 E

[58] Field of Search ..... 112/158 B, 158 E, 77, 112/264.1, 235, 65

[56] References Cited

U.S. PATENT DOCUMENTS

| | | | |
|---|---|---|---|
| 4,019,449 | 4/1977 | Hauf | 112/158 B |
| 4,056,070 | 11/1977 | Hauf | 112/158 B |
| 4,159,688 | 7/1979 | Garron et al. | 112/158 B X |

*Primary Examiner*—Peter P. Nerbun

*Attorney, Agent, or Firm*—Edward P. Schmidt; Robert E. Smith; Edward L. Bell

[57] ABSTRACT

An optical buttonhole switching arrangement in which the movement of reflective means carried on a moveable buttonhole foot are sensed as the foot is moved by the fabric feeding movement of a feed dog against the garment being sewn. The foot includes adjustable optical targets whose movement may be sensed by a photosensor carried on the sewing head. The spacing of the optical targets may be manually adjusted to accommodate buttons of different sizes. The photosensor is connected to an electronic circuit whose output may be used to control the retrieval of buttonhole stitching information from an electronic memory.

6 Claims, 4 Drawing Figures

OPTICAL SWITCHING DESIGN FOR ONE STEP BUTTONHOLING

BACKGROUND OF THE INVENTION

1. Field of the Invention

This invention relates to zig zag sewing machines in general, and in particular to machines having the capability of producing buttonholes of various sizes from stitch pattern information stored in an electronic memory.

2. Description of the Prior Art

Many different types of automatic buttonhole mechanisms are presently in use on sewing machines. One form of buttonhole mechanism gauges the length of buttonhole to be sewn on the basis of a switch having mechanical contacting elements whose spacing are varied according to the size of the button to be accommodated. Still other buttonhole mechanisms are controlled by wheels which engage and are driven by the fabric and which have optical sensors for determining the length of travel of the wheel. There are also known buttonhole mechanisms which are controlled by conductive marks which may be placed on the fabric in the location at which it is desired to start and terminate the buttonhole.

Recent developments in the sewing machine art have produced sewing machines in which stitch pattern information may be stored in and retrieved from an electronic memory. Such machines have a wide range of capabilities, limited only by the ability of the machine to retrieve stitch pattern information and apply it to the sewing instrumentalities.

One problem with prior known buttonhole mechanisms is that they are susceptible to faulty operation when their actuation is dependent on placing marks on the fabric.

Another problem is that the mechanisms are not fully compatible with electronic sewing machines having stitch pattern information stored in an electronic memory.

Still another problem is that some buttonhole mechanisms are susceptible to false operation due to the operator manipulating the fabric in the vicinity of the presser bar.

SUMMARY OF THE INVENTION

It is an object of this invention to provide an optical buttonhole mechanism which will produce a correctly sized buttonhole without operator intervention.

It is also an object of this invention to provide a buttonhole mechanism which is compatible with a sewing machine having buttonhole information stored in an electronic memory.

Still another object is to provide an automatic buttonhole mechanism which is immune to dust and lint in the vicinity of the stitch forming area of the sewing machine.

The above and other objects are achieved by affixing to the sewing machine presser bar a buttonhole foot having a manually adjustable button gauging element in which a button may be placed. The button gauging element includes a slidable portion which may be adjusted to accommodate different sizes of buttons. The foot also includes a fixed opaque target area, and a reflective target area which is carried on the slidable portion of the button gauging element and which may be moved relative to the opaque target. Optical sensor means cooperate with the reflective and opaque target areas to indicate to a buttonhole sensor circuit the beginning and end locations of the desired buttonhole. The buttonhole sensor circuit may be used to retrieve stitch pattern information from an electronic memory contained within the sewing machine to control the production of a buttonhole.

BRIEF DESCRIPTION OF THE DRAWINGS

The above objects and other advantages of this invention will become evident from an understanding of the preferred embodiment which is hereinafter set forth in sufficient detail to enable those skilled in the art to understand the function, operation, construction and advantages of it when read in conjunction with the accompanying drawings in which.

DESCRIPTION OF THE PREFERRED EMBODIMENT

Figure 1:
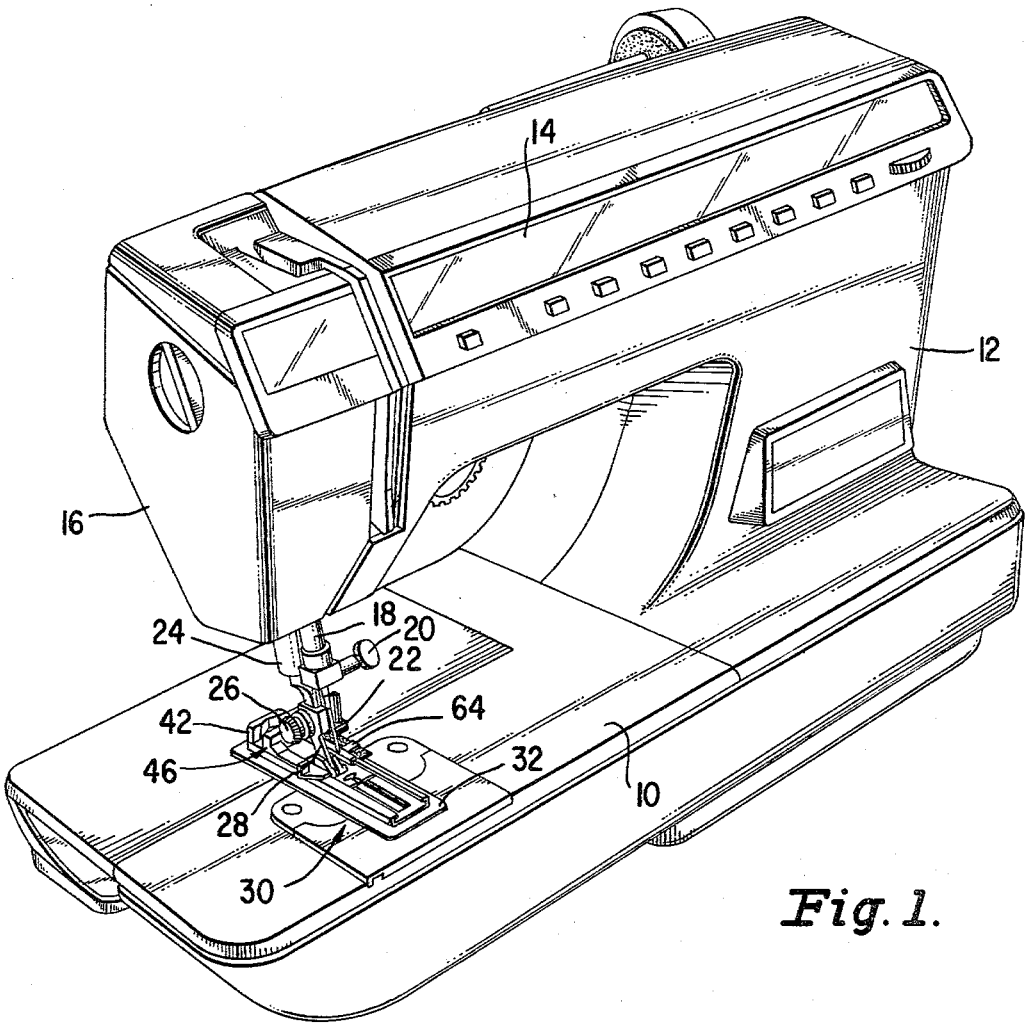
FIG. 1 is a perspective view of a sewing machine having a buttonhole mechanism incorporating the teachings of this invention applied thereto.

Referring to the drawings, FIG. 1 shows a sewing machine having a bed 10. A standard 12 rises from the bed 10 and supports an arm 14 which overhangs the bed 10 and which terminates in a sewing head 16. Journalled in the sewing head 16 and adapted for endwise reciprocatory motion toward and away from a stitch forming area contained on the bed 10 is a needle bar 18 which has a clamp screw 20 to fasten thereto a sewing needle 22. Also journalled in the sewing head 16 is a presser bar 24 which has a clamp screw 26 for retaining thereto the shank portion 28 of a buttonhole foot which is shown generally at 30. The downwardly biased buttonhole foot cooperates with a feed dog (not shown) which rises through the stitch forming area on the bed 10 to move fabric being sewn past the needle 22 during the stitch forming operation.

Figure 2:
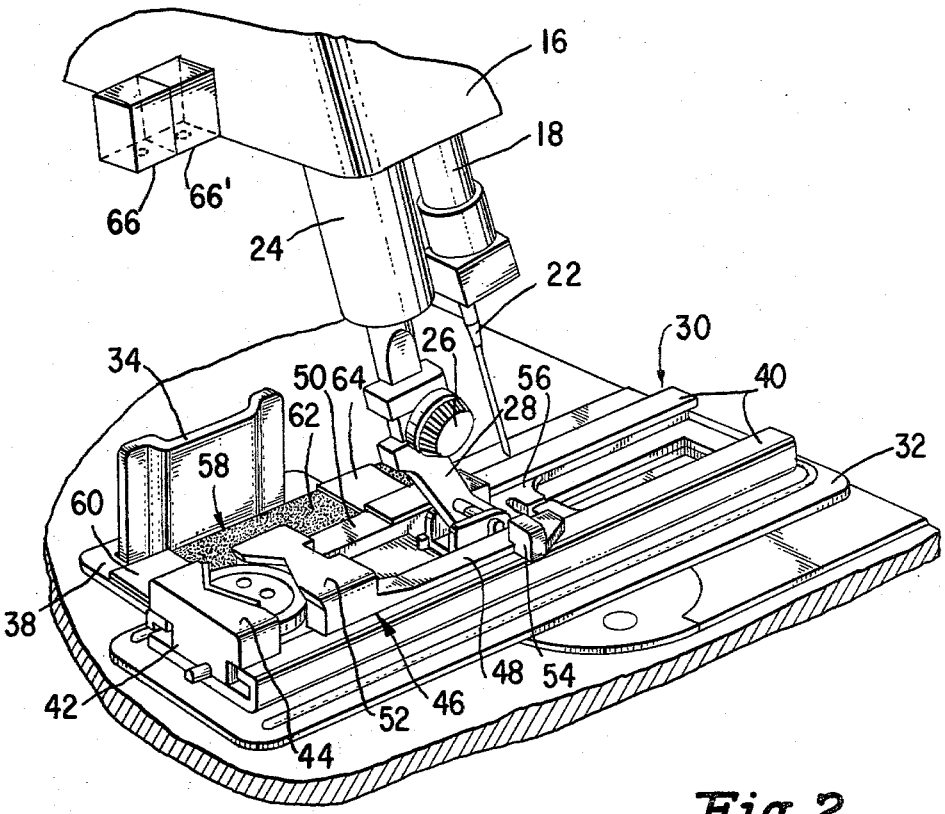
FIG. 2 is a perspective view of a buttonhole presser foot modified in accordance with the teachings of this invention.

The optical buttonhole mechanism disclosed herein may preferably cooperate with the buttonhole presser device disclosed in U.S. Pat. No. 3,877,403 which issued on Apr. 15, 1975 to Ketterer, the rights to which are owned by the assignee of this invention and the teachings of which are incorporated herein by reference. As is more particularly disclosed in the Ketterer patent, the buttonhole foot 30 which is best shown in FIG. 2, includes a work engaging plate 32 which has an upstanding side wall 34 at the rearward extremity thereof. The upstanding wall 34 receives a plate 38 which has fastened thereto a pair of spaced parallel tracks 40 which extend longitudinally in the direction of material feed on either side of an area penetrated by the endwise reciprocation of the needle 22. Fastened to the rearward extremity of the plate 38 between the tracks 40 is an anchor element 42 which includes an upward extending abutment 44 which has a "V" notch formed therein.

The spaced parallel tracks 40 constrain a slidable button gauging element 46 and permit linear motion of the element 46 therealong. The button gauging element 46 is formed with spaced parallel guide rails 48 and 50 which are each shaped to overlie one of the tracks 40 and which also have an inturned lip (not shown) to retain the button gauging element 46 to the tracks 40. The button gauging element 46 may be shifted toward and away from the anchor element 42 along the length of the tracks 40. The button gauging element 46 includes an upstanding portion 52 having a "V" shaped notch complemental to the notch carried in the abutment 44. The guide rail 48 includes an actuating tab 54 which may be grasped by an operator to slide the button gauging element 46 along the spaced parallel tracks 40. The presser foot 30 includes a slidable foot element 56 to which the shank 28 is pivotally fastened, and which is slidably mounted between the tracks 40 to permit movement of the buttonhole foot 30 along the line of material feed.

The optical buttonhole switching mechanism disclosed herein includes a fixed optical target 58 which is fastened to the plate 38 parallel to the tracks 40 and preferably is adjacent to the upstanding wall 34 of the work engaging plate 32. The fixed optical target 58 preferably includes a reflective portion 60 at the rearward extremity thereof, and a portion 62 having a low coefficient of reflectivity. Preferably the guide rail 50 of the button gauging element 46 has fastened thereto a moveable optical target 64 which has a high coefficient of reflectivity similar to the reflectivity exhibited by the reflective portion 60 and which overlies the portion 62 of the optical target 58. The moveable target 64 may be moved along the length of the fixed optical target 58 relative to the reflective extremity 60 by operator controlled movement of the button gauging element 46 through the use of the actuating tab 54.

The sewing head 16 has fastened thereto an optical sensor means, which is preferably shown as a pair of photosensors 66 and 66'. The sensors 66 and 66' are positioned so that they receive light which is reflected from the fixed optical target 58 or the moveable optical target 64 as the buttonhole foot 30 is moved thereunder by motion of the feed dog (not shown) in the direction of material feed. The sensors 66 and 66' are spaced apart from each other along the line of fabric feeding so that they are sequentially exposed to light reflected from either the reflective portion 60 or the moveable target 64.

Figure 3:
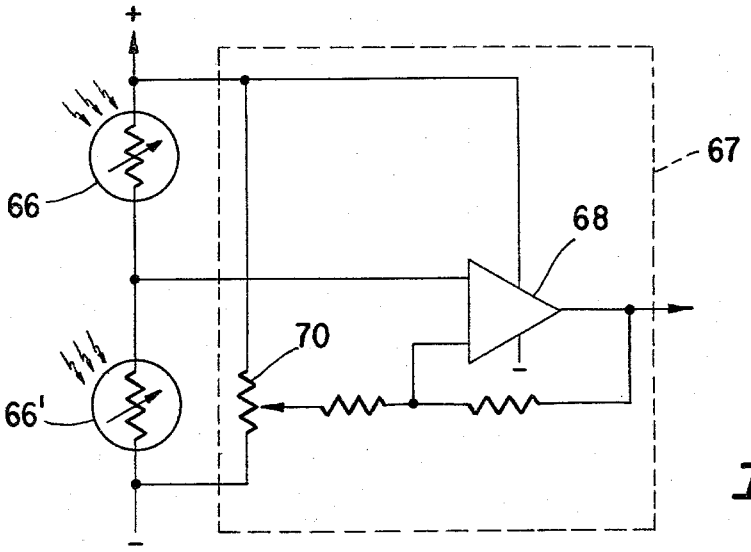
FIG. 3 is an electronic schematic diagram of a preferred circuit which may be used to determine the location of the front and rear bartacks for a buttonhole produced by a mechanism constructed in accordance with the teachings of this invention.

FIG. 3 shows a preferred embodiment of an electronic circuit 67 which may be used to sense the change in resistance or other electrical characteristic of the photosensors 66 and 66' due to the change in light reflected thereto by the optical targets on the buttonhole foot 30. The sensors form a bridge arrangement which is connected to an operational amplifier 68. A potentiometer 70 is preferably included to adjust the sensitivity of the circuit to sense varying changes in light reflected from the reflective portions 60 and 64 relative to the light absorptive portion 62. It will be seen from FIG. 3 that since the circuit responds to a change in the resistance of one photosensor relative to the second photosensor, the circuit will not produce an output if both sensors are simultaneously exposed to light. The circuit is therefore made insensitive to false triggering occassioned by stray light or shadows cast in the vicinity of the sewing head 16.

Figure 4:
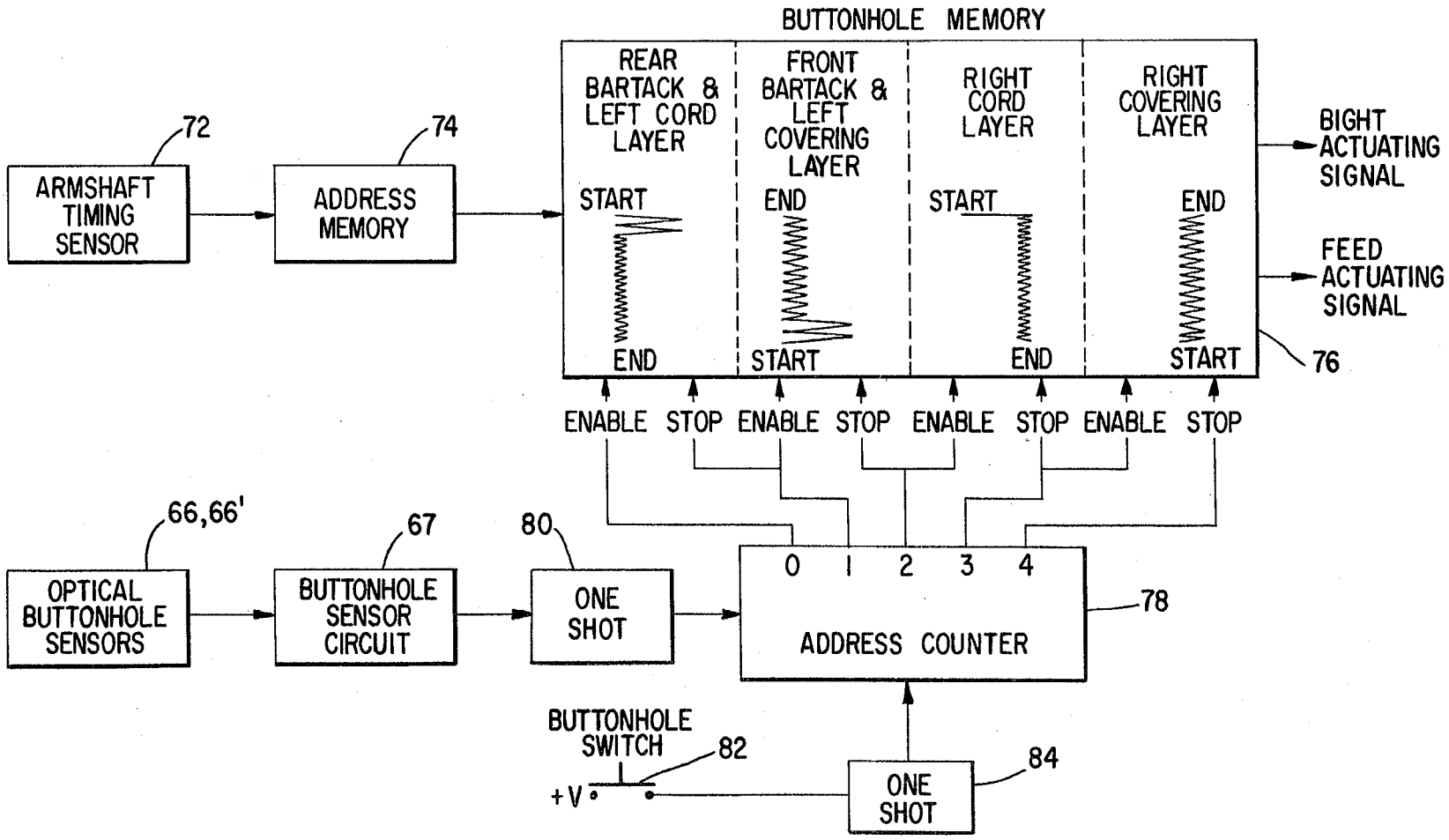
FIG. 4 is an electronic block diagram of a buttonhole system which may be controlled by the mechanism of this invention.

The output of the operational amplifier 68 may control the operation of an automatic buttonholing circuit, an example of which is shown in block format in FIG. 4. The circuit shown in FIG. 4 may preferably be used to retrieve buttonhole stitch pattern information which is stored in an electronic memory. An example of how stitch pattern information, including buttonhole information, may be stored and retrieved from an electronic memory may be had by reference to U.S. Pat. No. 3,877,808 which issued to J. W. Wurst on Mar. 25, 1975, the rights to which are owned by the assignee of this application, and the teachings of which are incorporated herein by reference.

As is more particularly disclosed in the aforementioned U.S. Patent to Wurst, an armshaft timing sensor 72 may be used to retrieve memory address information stored in an address memory 74. The address memory information may be applied to retrieve stitch pattern information from an electronic memory means, a portion of which is shown at 76, in which may be stored electronic signals which may be applied to a needle bar actuating means and a feed dog actuating means to produce stitch patterns, including buttonholes. An address counter 78 accesses the buttonhole stitch pattern information stored in the electronic memory 76, in response to commands received from the buttonhole sensor circuit 67. Preferably the output of the operational amplifier 68 which constitutes the output of the sensor circuit 67 is applied to a one shot circuit 80 which supplies a pulse to the address counter 78 in response to a change in the reflectance of the optical target 58 sensed by the photosensors 66 and 66'. The address counter 78 is enabled when a buttonhole switch 82 is activated by the sewing machine operator, when it is desired to sew a buttonhole, which causes a one shot 84 to supply a pulse to one input of the address counter 78. The address counter 78 will thereafter be incremented one step for each time that the one shot 80 supplies a pulse thereto in response to the sensing of a transition in the reflectivity at either extremity of the optical target 58 by the photosensors 66 and 66'.

The operation of the optical buttonholing mechanism is carried out by the operator placing a button within the buttonhole foot between the abutment 44 and the button gauging element 46 and pushing the actuating tab 54 so that the button is firmly retained therebetween. Movement of the gauging element 46 along the tracks 40 causes the moveable optical target 64 to be moved along the fixed optical target 58 relative to the fixed reflective portion 60, the amount of the portion 62 of the target 58 that lies between the reflective areas 60 and 64 being proportional to the diameter of the button contained between the abutment 42 and the gauging element 46. The operator commences sewing after activating the buttonholing mechanism by pushing the buttonhole switch 82 which causes the one shot 84 to apply a pulse to the address counter 78 to make it responsive to signals received from the buttonhole sensor circuit 67 via the one shot 80.

The buttonhole memory 76 supplies commands in the form of bight actuating signals and feed actuating signals which cause the needle and feed dog respectively to sequentially produce a rear bartack and a left cord layer in the garment at the position of the buttonhole. The feed dog is commanded by the buttonhole memory 76 to stop feeding the garment when the photosensors 66 and 66' sense the transition between the portion 62 of the optical target 58 having a low coefficient of reflectivity and the moveable target 64 having a high coefficient of reflectivity, as they are driven along the line of material feed by the motion of the feed dog. The reflectivity variation is sensed by the photosensors 66 and 66' which causes the buttonhole sensor circuit 67 to trigger the one shot 80 which increments the address counter 78. The address counter 78 thereafter causes the buttonhole memory to supply bight and feed signals to the needle bar 18 and the feed dog which reverses the direction of fabric feeding and which produces a fron bartack and left covering layer along the left edge of the buttonhole. The address counter 78 is again incremented by the one shot 80 when the buttonhole sensor circuit 67 senses a change in the outputs of the photosensors 66 and 66' due to the variation in reflectivity between the reflective portion 60 and the opaque portion 62 as the buttonhole foot is driven backwardly toward the stitch forming area.

The buttonhole memory 76 moves the buttonhole foot 30 in two additional excursions past the stitch forming area to sequentially stitch the right cord layer and the right covering layer of the buttonhole. At the end of the right covering layer the buttonhole sensor circuit 67 once again supplies an output based on the reflectivity difference between the reflective portion 60 and the portion 62 observed by the photosensors 66 and 66'. The last transition clears the address counter 78 and disables the buttonhole function until the operator once again operates the buttonhole switch 82.

It will be understood that what has been disclosed herein is a novel optical buttonhole switching arrangement which finds particular utility when applied to a sewing machine having stitch pattern information stored in an electronic memory. It will be appreciated that modifications and variations of the above described invention may become evident to one skilled in the art in light of the above teachings. However, it is to be understood that the present disclosure relates to but one preferred embodiment which is for the purpose of illustration only, and should not be construed as a limitation on the scope of the invention. All modifications which do not depart from the spirit of the invention are intended to be included within the scope of the appended claims.

We claim:

1. An optical buttonhole mechanism for a zig zag sewing machine having a work supporting surface with a stitch forming area contained thereon, a sewing head overhanging said work supporting surface, a needle bar carrying a needle in endwise reciprocatory motion toward and away from said stitch forming area, a presser bar journalled in said sewing head and extending toward said work supporting surface, said presser bar having fastened thereto a buttonhole foot for containing a garment being sewn against the upward thrust of a feed dog rising from said work supporting surface, said buttonhole foot being moveable along a line of material feed toward and away from said stitch forming area by the fabric feeding movement of said feed dog and including adjustable means for retaining thereon a button, wherein the improvement comprises an adjustable reflective means carried on said buttonhole foot, said reflective means being adjustable in response to the size of button contained by said adjustable button retaining means, photosensor means responsive to light reflected from said reflective means for determining the position of said buttonhole foot relative to said stitch forming area on said bed, as said buttonhole foot is moved past said stitch forming area, and electronic circuit means for sensing the change in reflectance from said reflective means sensed by said photosensor means.

2. The optical buttonhole mechanism as set forth in claim 1 wherein said adjustable reflective means further includes a first area having a high coefficient of reflectivity at a starting location for a buttonhole and a second area having a high coefficient of reflectivity at a terminating location for a buttonhole, and a third area extending between said first area and said second area having a coefficient of reflectivity differing from said reflectivity of said first and said second areas.

3. The optical buttonhole mechanism as set forth in claim 1 wherein said photosensor means comprises two photosensors spaced along the line of material feed, said sensors having outputs changing simultaneously when affected by stray lighting and changing sequentially when sensing a change due to the difference in reflectivity between said first and said third reflective areas, and said third and said second reflective areas, whereby said optical buttonhole mechanism is made immune to the effects of stray lighting in said stitch forming area.

4. The optical buttonhole mechanism as set forth in claim 3 wherein said electronic circuit means comprises a balanced bridge circuit, said two photosensors forming two legs of the bridge, and an operational amplifier supplying an output when the electrical characteristics of one photosensor changes relative to the electrical characteristics of the other photosensor.

5. The optical buttonhole mechanism as set forth in claim 4 wherein an adjustable resistor is connected between the output of one photosensor and an input of said operational amplifier to adjust the difference in the electrical characteristics between the photosensors at which the operational amplifier will supply an output.

6. An optical buttonhole mechanism for a zig zag sewing machine having a work supporting surface with a stitch forming area contained thereon, a sewing head overhanging said work supporting surface, a needle bar carrying a sewing needle in endwise reciprocatory motion toward and away from said stitch forming area, a presser bar journalled in said sewing head and extending toward said work supporting surface, said presser bar having fastened thereto a buttonhole foot for containing a garment being sewn against the upward thrust of a feed dog rising from said work supporting surface, said buttonhole foot being moveable along a line of material feed toward and away from said stitch forming area by the fabric feeding movement of said feed dog and including adjustable means for retaining thereon a button, electronic memory means for retaining buttonhole stitch pattern information for controlling the motion of said needle bar and said feed dog, wherein the improvement comprises an adjustable reflective means carried on said buttonhole foot, said reflective means being adjustable to the size of button contained by said adjustable retaining means, photosensor means responsive to light reflected from said reflective means for determining the position of said buttonhole foot relative to said stitch forming area on said bed, electronic circuit means for sensing the change in reflected light from said reflective means sensed by said photosensor means, and means responsive to said electronic circuit means for retrieving buttonhole stitch pattern information from said electronic memory means and for applying said information to control said feed dog and said needle bar.

* * * * *